US012449204B2

(12) United States Patent
Noriega

(10) Patent No.: US 12,449,204 B2
(45) Date of Patent: Oct. 21, 2025

(54) HEAT EXCHANGER

(71) Applicant: Victor Manuel Aguilar Noriega, Mexicali (MX)

(72) Inventor: Victor Manuel Aguilar Noriega, Mexicali (MX)

( * ) Notice: Subject to any disclaimer, the term of this patent is extended or adjusted under 35 U.S.C. 154(b) by 147 days.

(21) Appl. No.: 18/373,915

(22) Filed: Sep. 27, 2023

(65) Prior Publication Data

US 2024/0053105 A1 Feb. 15, 2024

(30) Foreign Application Priority Data

Aug. 9, 2022 (MX) ..... MX/a/2022/009800

(51) Int. Cl.
*F28D 7/10* (2006.01)

(52) U.S. Cl.
CPC ..... *F28D 7/10* (2013.01)

(58) Field of Classification Search
CPC ..... F28D 7/103; F28D 7/10
See application file for complete search history.

(56) References Cited

U.S. PATENT DOCUMENTS

| | | | | |
|---|---|---|---|---|
| 3,885,125 A * | 5/1975 | Palm | ..... | F28F 13/12 165/157 |
| 6,880,623 B2 * | 4/2005 | Gierlings | ..... | F28D 7/103 165/145 |
| 11,280,341 B2 | 3/2022 | Bauduin | | |
| 2017/0167751 A1 * | 6/2017 | Frechette | ..... | F24H 1/287 |

FOREIGN PATENT DOCUMENTS

| | | | | |
|---|---|---|---|---|
| CN | 101313183 B | 11/2008 | | |
| CN | 108603727 A | 9/2018 | | |
| CN | 215261294 U | 12/2021 | | |
| DE | 102007009392 A1 * | 10/2008 | ..... | F22G 3/005 |
| RU | 2483264 C2 | 5/2013 | | |
| WO | WO-9303318 A1 * | 2/1993 | ..... | F28D 7/024 |

* cited by examiner

*Primary Examiner* — Eric S Ruppert
(74) *Attorney, Agent, or Firm* — Bauer and Joseph; Thomas Joseph

(57) ABSTRACT

A heat exchanger comprising a chamber other than a coil is provided. The heat exchanger withstands high operating pressures and allows a reduction of fuel, avoiding the excessive generation of pollutants.

1 Claim, 5 Drawing Sheets

HEAT EXCHANGER

CROSS REFERENCE TO RELATED APPLICATION

This application claims the benefit of Mexican Patent Application No.

MX/a/2022/009800 entitled "HEAT EXCHANGER", filed Aug. 9, 2022, which is incorporated herein by reference.

FIELD OF INVENTION

The present disclosure belongs to the technical field of heat exchangers. Specifically, this invention provides a heat exchanger comprised of a chamber different from a coil.

BACKGROUND OF THE INVENTION

Document PL3786559 describes an assembly of heat exchanger that includes a heat exchanger panel arranged in an inclined position. A fan assembly is arranged vertically on the heat exchanger panel and includes a fan impeller connected to a fan support. The fan impeller is sized and positioned so that part of the fan impeller rotates vertically above the upper end of the heat exchanger panel. It is also comprised of a shell that has a plurality of inner walls to guide the air from the heat exchanger panel to the fan assembly. The inner walls include a slanted wall. The distance between an upper end of the slanted wall and the rotation axis of the fan is greater than the distance between the lower end of the slanted wall and the rotation axis of the fan. The slanted wall is adjacent to the upper end of the heat exchanger panel in such a way that the fan impeller rotates vertically above the slanted wall.

Document CN215261294 describes a dual-source switchable heat exchanger that is comprised of a heat exchange exhaust for liquid working medium and an external air heat exchanger fin that is installed in the frame of the main body, the heat exchange exhaust for the liquid working medium is connected to the external air heat exchanger fin, and the heat exchange exhaust for the liquid working medium is formed by connecting an inner tube and an outer tube of two concentric circles with different sizes, and the external air heat exchange fin is arranged on the outer wall of the outer tube. A sealing plate on the upper side is mounted in the upper part of the main body's frame. Sealing plates on the lateral surface are mounted on the left and right side of the frame, and a bottom plate on the lower side is mounted on the underside of the lateral surface of the sealing plates. A base is arranged in the bottom plate of the lower side, and shutters that can be opened are mounted on the frontal and rear sides of the main body's frame. This heat exchanger can exchange heat with air mediums and liquid working mediums, so that one heat exchanger can use two heat sources at the same time, or it is able to change the heat exchange working mediums from one side to the other in order to adapt to complex external environments, the heat exchange efficiency of the heat exchanger improves considerably, the usage cost is reduced, and the application perspective is broad.

Document CN108603727 describes a water-heating apparatus that includes an elongated radial burner that extends throughout a longitudinal central axis of the apparatus. A first and second concentric rows of fin tubes extend longitudinally around the radial burner. The fin tubes can have multiple circumferentially laterally rubbed portions that allow for their compact packing to improve efficiency and reduce occupied space.

Document RU2483264 describes a heat exchanger belonging to a system for heating liquids which includes a shell with a cover plate with a base to install the burner. On the opposite side a flue is connected, in such a way that it interconnects with a rotating flue gas collector. The flue forms in tandem with the shell a liquid volume, restricted by front and rear tube sheets with tubes attached to them, which are evenly positioned around the flue with gaps in relation to the shell and the flue. The inlet piping sections are routed to a rotating head and the outlet piping sections are directed toward an annular flue gas header. Between the end walls of the rotating flue gas header and the space formed therein is an inlet to a liquids chamber interconnected with a liquid supply connection tube. The end wall of the rotating flue gas collector is adjacent to the periphery of the frontal tube sheet and forms, together with the shell, an annular interconnecting channel of the inlet to the liquid chamber with the liquid volume. The annular flue gas header is formed by a wall that is concentric to the flue connected to the periphery of the rear tube sheet and the shell cover plate, which, in turn, together with the shell forms an annular cavity for liquids, enclosing the annular flue gas header, which is interconnected with the liquid volume, and the connection pipe for discharging liquid. The annular flue gas header goes through the annular cavity for liquids.

Document CN101313183 describes a device to avoid the initial hot water discharging onto the dual-pipe heat exchanger, and a method to control it, that can also temporarily mix cold water with hot water to decrease the temperature of the hot water that discharges when the temperature is high. Water initially discharges from the dual-pipe heat exchanger. The device for preventing initial hot water discharge from a dual-pipe heat exchanger that includes a cold water pipe into which cold water is introduced, a hot water heat exchanger pipe to absorb the heat from combustion from a burner to heat the cold water onto the hot water; and to discharge hot water, a pipe of hot water for supplying high temperature hot water, discharged from the hot water heat exchange piping, and a heating water heat exchange pipe having both ends connected to a heating water return inlet and a heating water discharge outlet heating water pipe and arranged in the hot water heat exchange pipe includes: a bypass pipe that extends between a cold water pipe and a hot water pipe, to directly supply cold water in the cold water pipe to the hot water pipe; a mixing valve mounted on an end of the bypass pipe; a heating water temperature sensor mounted on the heating water discharge outlet, to detect the temperature of the heating water; a hot water temperature sensor mounted on the hot water supply pipe, to detect the temperature of the hot water; and a controller to receive the temperature values detected by the heating water sensor, and the hot water temperature sensor to control the degree of aperture of the mixing valve.

OBJECTIVES OF THE INVENTION

The objective of this invention is providing a heat exchanger comprised of a chamber different from a coil, that withstands 3000 psi of hot water pressure to 180° F. (82.2° C.).

Another objective of this invention is to provide a heat exchanger that allows saving energy.

Furthermore, it is one more objective to provide a heat exchanger that avoids excessive fuel consumption and reduces combustion gas emissions.

DETAILED DESCRIPTION OF THE INVENTION

The present disclosure provides a heat exchanger which differs from those described in the prior art by its design. Particularly, the heat exchanger of the present disclosure comprises a chamber other than a coil, which withstands 3000 psi of hot water pressure to 180° F. (82.2° C.). The present heat exchanger invention withstands steam at temperatures of 392° F. (200° C.).

Figure 1:
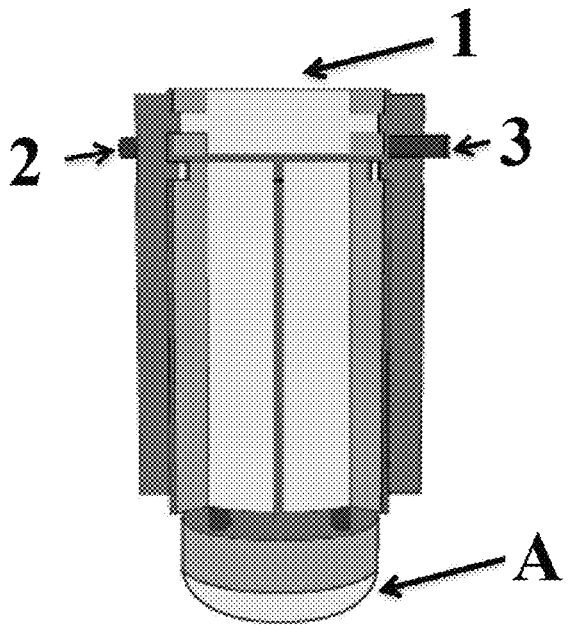
FIG. 1 illustrates the internal water and gas circulation system of the heat exchanger of the present disclosure.

Referring now to the drawings and, in particular, to FIG. 1, the heat exchanger includes a heat inlet 1, a cold-water inlet 2, a hot water outlet 3, and an insulator A. The heat exchanger is defined by a tube inside another tube wherein there is a chamber containing water.

Water is passed in a certain direction to receive the increased heat exchange that is generated by a burner that uses diesel fuel. The combustion gases are also directed in one direction so that they have the longest contact surface with the exchanger, thus achieving a double passage of the combustion gases, which increases its efficiency and reduces diesel consumption by approximately 40%.

The heat exchanger is also comprised of an internal sheet (IS) that functions as a seal to benefit the appropriate circulation of gases. Furthermore, this exchanger is also comprised of an exterior sheet (ES) that provides a proper seal, and also functions as insulation against burns.

Figure 2:
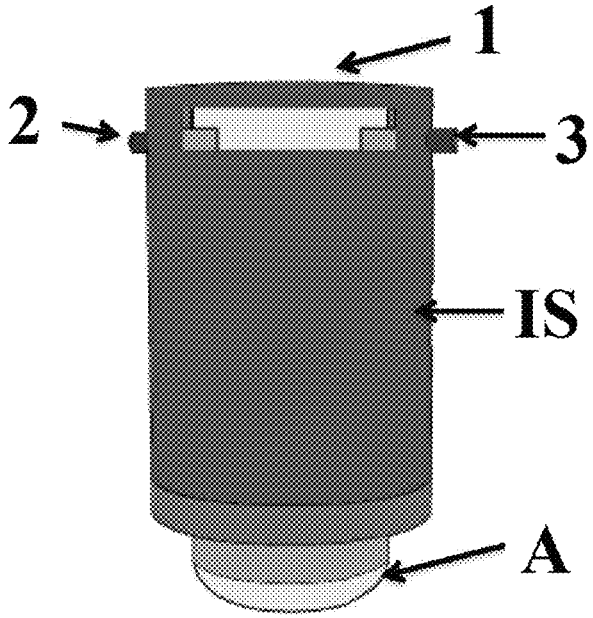
FIG. 2 illustrates the sealing sheet used in the heat exchanger of the present disclosure.

FIG. 2 has an insulator illustrated with the reference (IS); this insulator can be of mineral wood. Moreover, the function of the exterior sheet (ES) is to avoid people burning themselves when they come into contact with this part.

Figure 3:
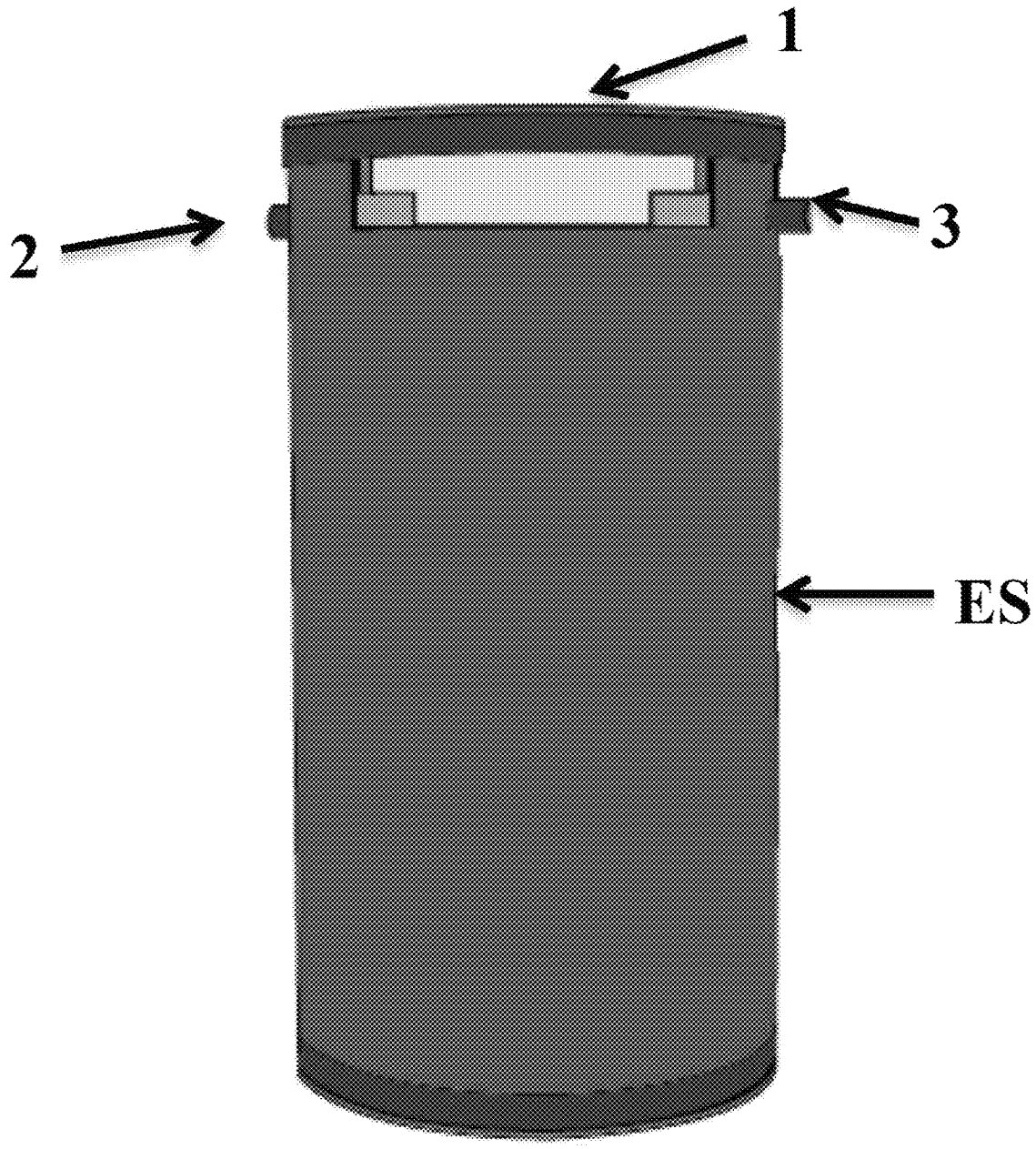
FIG. 3 illustrates the exterior sheet used in the heat exchanger of the present disclosure.

FIG. 3 discloses an exterior sheet 3 that is used within the heat exchanger.

Figure 4:
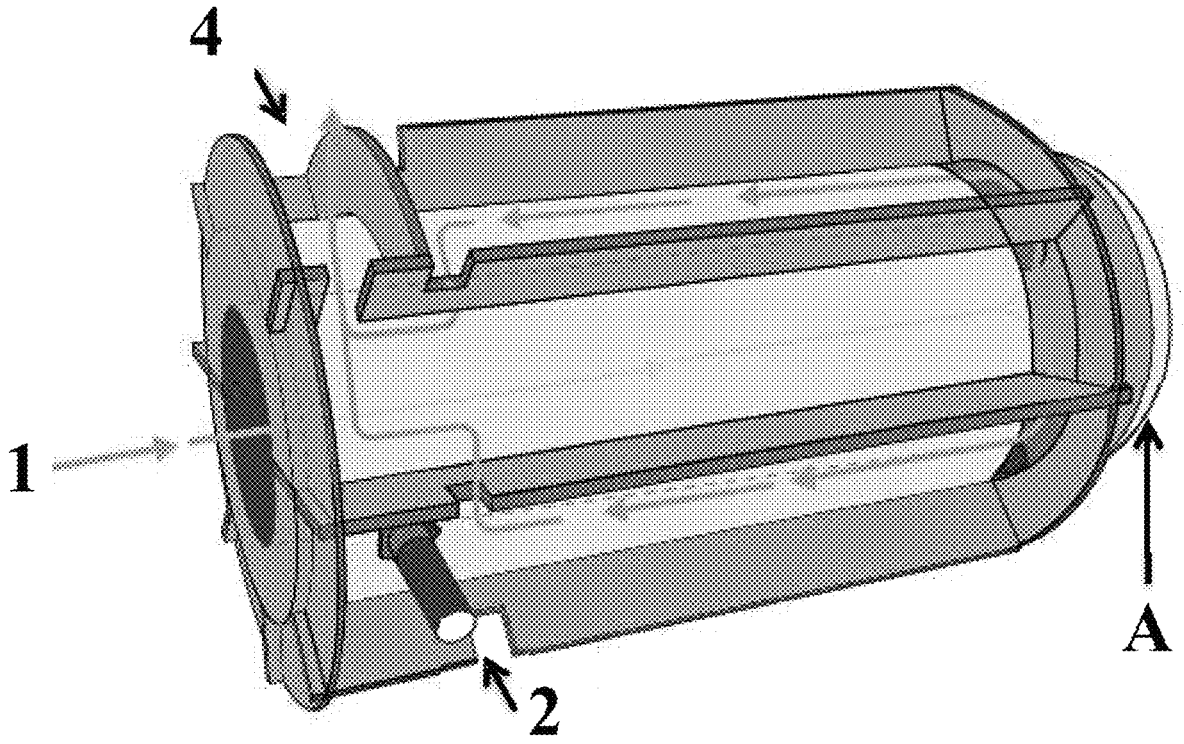
FIG. 4 illustrates a complementary view of the heat and gas circulation of the heat exchanger of the present disclosure.

FIG. 4 shows a heat inlet 1, and the internal circulation of gases through the heat exchanger structure. This is a double circulation, which means that it emits double the heat.

FIG. 4 shows how the heat enters through the internal part and exits through the external part. That is, heat enters through the heat inlet 1 and returns at the top, coating the 1.8-inch diameter and passes into an 8-inch diameter tube.

Gases can escape from an outlet 4. The outlet 4 can include an exhaust gas outlet hatch that can be manufactured from metal, such as A 36 steel.

Figure 5:
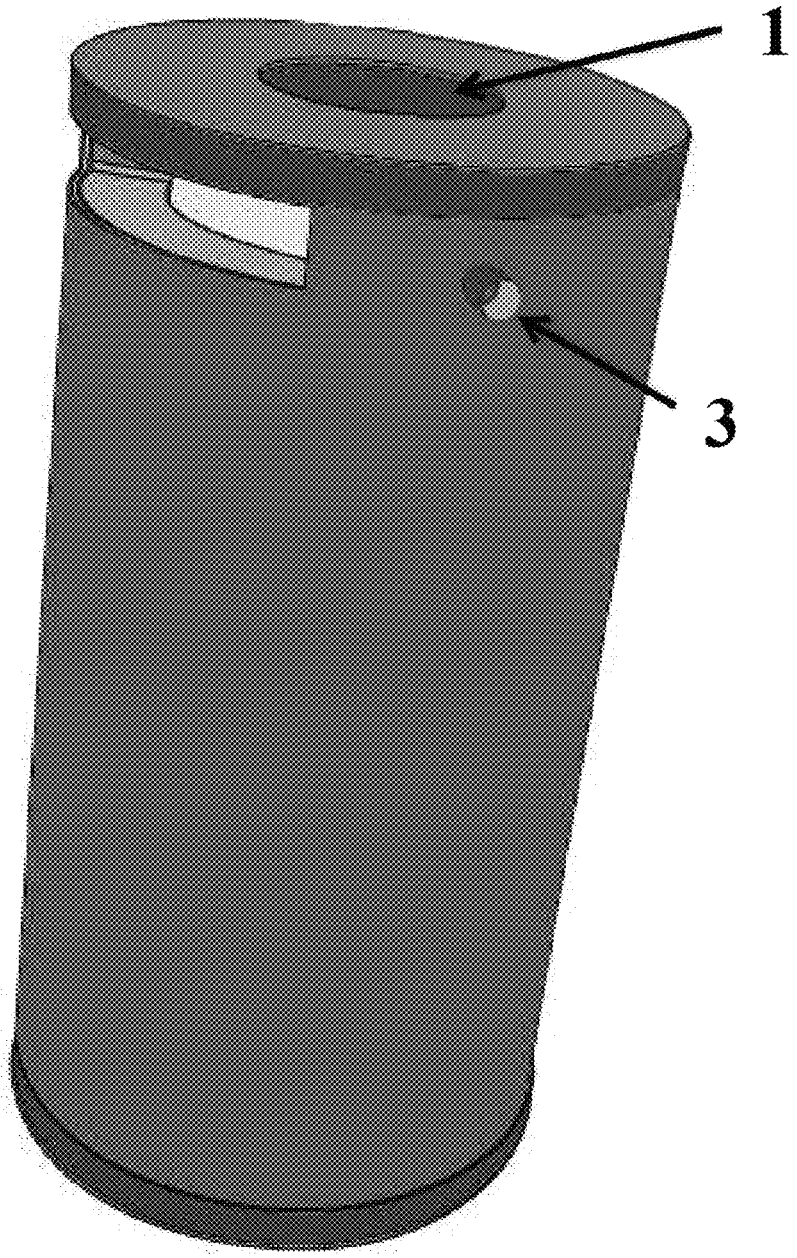
FIG. 5 illustrates a perspective visualization of the heat exchanger of the present disclosure.

As shown in FIG. 5, the insulation provided by the two sheets (IS) and (ES) can be perfectly observed through the present indentation.

Figure 6:
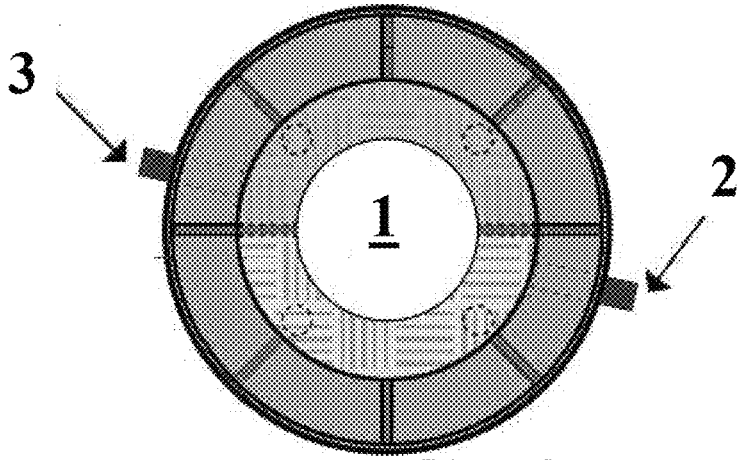
FIG. 6 illustrates a cross sectional view of the heat inlet, insulation, and water circulation of the heat exchanger of the present disclosure.
Figure 7:
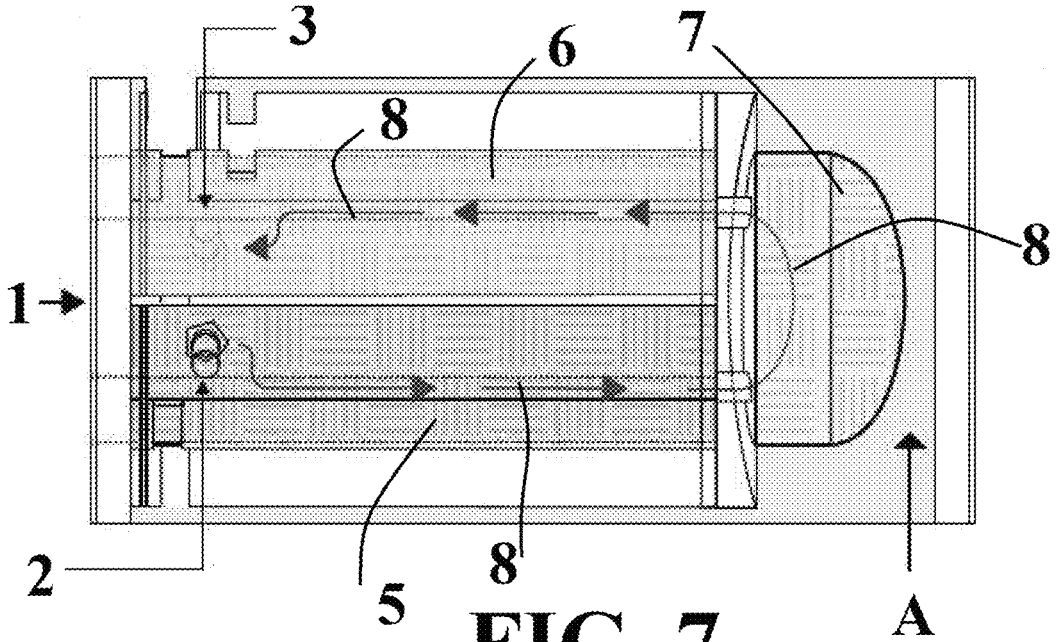
FIG. 7 illustrates a cross sectional view in side elevation of the heat inlet, insulation, and water circulation of the heat exchanger of the present disclosure.

As shown in FIGS. 6-7 with continuing reference to the foregoing figures, the heat exchanger comprises a cold-water inlet 2, a hot water outlet 3, and an insulator A.

FIG. 6 shows a division, which makes it a double circulation and all the heat that is generated is used at the bottom and at the top, and the heat is used again when the currents collide, that is to say, there is a double circulation in the gases and in the water.

As shown in FIG. 7, a cold water section 5 holds cold water. A hot water section 6 holds hot water. A transition section 7 provides for the transformation of the cold water into hot water with the water circulating through the heat exchanger along a flow path 8.

I claim:

1. A heat exchanger that withstands 3000 psi of hot water pressure at 180° F. (82.2° C.), the heat exchanger comprising:

an outer tube having a water inlet for receiving cold water therein and a hot water outlet for producing hot water therefrom;

an intermediate tube inserted into the outer tube to form a chamber therebetween;

an inner tube inserted into the intermediate tube and having a heat inlet therein;

a transition section having a tubular cylindrical portion positioned at one end of the outer tube, the intermediate tube, and the inner tube and a domed portion positioned on the tubular cylindrical portion with the tubular cylindrical portion and the domed portion having an interior in fluid communication with the chamber;

an insulator covering the transition section domed portion, at least partially;

an interior sheet positioned around the outer tube for sealing gases therein;

an exterior sheet positioned around the interior sheet that includes insulating material therein;

wherein a plurality of dividers is positioned between the outer tube and the intermediate tube, so that the chamber is divided into at least two divisions with each division being in fluid communication with the transition section interior, so that cold water flows into the water inlet, circulates from one of the divisions to the second division through the transition section interior, receives heat from the inner tube to transform the cold water into hot water, flows from the second division and out of the hot water outlet.

* * * * *